US005759055A

United States Patent [19]

Colantuano et al.

[11] Patent Number: 5,759,055

[45] Date of Patent: Jun. 2, 1998

[54] INTERLOCKING TERMINAL CONNECTION

[75] Inventors: Robert G. Colantuano; Charles W. Kuster, both of Ft. Wayne, Ind.

[73] Assignee: United Technologies Automotive, Inc., Dearborn, Mich.

[21] Appl. No.: 867,179

[22] Filed: Jun. 2, 1997

Related U.S. Application Data

[63] Continuation of Ser. No. 661,057, Jun. 10, 1996, abandoned.

[51] Int. Cl.[6] ..... H01R 13/28

[52] U.S. Cl. ..... 439/287; 439/883; 439/907

[58] Field of Search ..... 439/801, 287, 439/860, 883, 907

[56] References Cited

U.S. PATENT DOCUMENTS

| | | | |
|---|---|---|---|
| 1,874,593 | 8/1932 | Olson | 439/883 |
| 3,761,867 | 9/1973 | Churla | 439/883 |
| 4,273,401 | 6/1981 | Katzin | 439/860 |
| 5,342,222 | 8/1994 | Toshiharu et al. | 439/708 |
| 5,529,509 | 6/1996 | Hayes et al. | 439/883 |
| 5,558,531 | 9/1996 | Ikeda et al. | 439/907 |

*Primary Examiner*—Neil Abrams
*Assistant Examiner*—T. C. Patel
*Attorney, Agent, or Firm*—Howard & Howard

[57] ABSTRACT

An interlocking terminal connection includes a pair of terminal plates each having a base portion with a hole for receiving a fastener. Each terminal plate further includes a pair of wing portions on either side of the base portion. The wing portions on a first terminal plate are displaced upwardly, while the wing portions on a second terminal plate are displaced downwardly. Each base portion includes a latch at the rearward end and a complementary latch window at its forward end. The base portion of the first terminal plate includes a plurality of downwardly deformed retaining members for preventing rotation of the terminal connection during mounting. Upon insertion of the first terminal plate into the second terminal plate, the base portions and wing portions interlock and the latch on each base portion is received within the latch window of the other base portion to prevent the release of the terminal plates. A fastener is then inserted through the holes in the base portions to secure the terminal plates to an object such as a grounding panel or frame.

14 Claims, 3 Drawing Sheets

INTERLOCKING TERMINAL CONNECTION

This application is a continuation of Ser. No. 08/661,057, filed Jun. 10, 1996, and now abandoned.

BACKGROUND OF THE INVENTION

The present invention relates to terminals for connecting a plurality of wires to a panel or frame.

In a vehicle there are numerous devices which must be grounded by connecting wires to a metal panel or to the car frame. Generally, each wire is connected to a terminal plate having a hole. A threaded fastener such as a screw is then inserted through the holes in two or more terminal plates and threaded into a panel or the car frame to provide an electrical ground.

The known terminal plates have several drawbacks. First, the known terminal plates are flat and are simply stacked one upon the other. Because the terminal plates are not connected, the assembler must insert the fastener through each of the plates and then into the panel or frame. Further, when the screw is threaded into the panel or frame, the terminal plates will rotate, twisting the wires.

One prior attempt to solve this problem utilizes a formed protector receiving bundles of wires including an earth end attaching member integrally formed with the protector and projecting from the side of the protector. The earth end attaching member includes a hole aligned with the holes in the terminal plates placed upon the earth end attaching member. Elastically deformable engaging parts secure the terminal plates to the earth end attaching member and the protector. However, this device increases the height of the connection to the panel or frame. Further, this device requires assembly of additional parts before securing the wires to the panel or frame.

SUMMARY OF THE INVENTION

The present invention provides an interlocking terminal connection for connecting wires to a frame or panel. The terminal connection generally includes a first terminal plate connected to one wire and a second terminal plate connected to a second wire. Each terminal plate includes a base portion having a hole for receiving a threaded fastener, such as a screw. Each terminal plate further includes an outer wing portion and an inner wing portion, both of which are displaced from the base portion. An interlocking finger extends forwardly from each wing portion. The wing portions on the first terminal plate are displaced upwardly from the base portion, while the wing portions on the second terminal plate are displaced downwardly from the base portion so that the interlocking fingers from one terminal plate will interlock with the interlocking fingers on the other terminal plate.

Each terminal plate includes a latch at a forward end of the base portion and a latch window at a rearward end of the base portion. Preferably, the lower surface of the base portion of the first terminal plate includes a plurality of downwardly deformed retaining members which cut into the panel or frame to prevent rotation of the connection and to cut through paint or dirt and provide good electrical contact.

In operation, the terminal plates are slid together such that the base portion of the second terminal plate abuts the upper surface of the base portion of the first terminal plate and the wing portions of the second terminal plate abut the lower surface of the wing portions of the first terminal plate ("the interlocked position"). Upon complete connection of the first terminal plate and second terminal plate, the latches in each terminal plate will be received in the latch window of the other terminal plate to place the first terminal plate and the second terminal plate in a "latched position", thereby preventing the separation of the first terminal plate and second terminal plate. A fastener, such as a screw, is then inserted through the aligned holes in the first terminal plate and second terminal plate and threaded into a panel or frame to provide an electrical ground to the wires. Upon tightening of the screw, the downwardly deformed retaining members will bite into the panel or frame to prevent rotation of the terminal plates and ensure good electrical contact with the panel or frame.

Alternatively, one or both of the holes in the first and second terminal plates may include a rearward portion of reduced diameter and a forward portion of increased diameter. The fastener includes a portion of reduced diameter, or undercut, on the shaft, preferably adjacent the head. The hole is shaped and dimensioned such that when the first plate and second plate are interlocked, but not latched, the forward portions of increased diameter are aligned and the fastener is inserted through the first and second terminal plates. The first and second terminal plates are then fully slid together into the latched position, in which the latches are received in the latch windows. In the latched position, at least a portion of the rearward portions of reduced diameter of the holes in the first and second plate are aligned, thereby reducing the diameter around the undercut in the fastener. The fastener is thereby retained by the first and second terminal plates, but is rotatable relative to the first and second plates. The first and second plates are then connected to a frame or panel by threading the fastener into the frame or panel.

BRIEF DESCRIPTION OF THE DRAWINGS

The above, as well as other advantages of the present invention, will become readily apparent to those skilled in the art from the following detailed description of a preferred embodiment when considered in light of the accompanying drawings in which.

DETAILED DESCRIPTION OF THE PREFERRED EMBODIMENT

Figure 1:
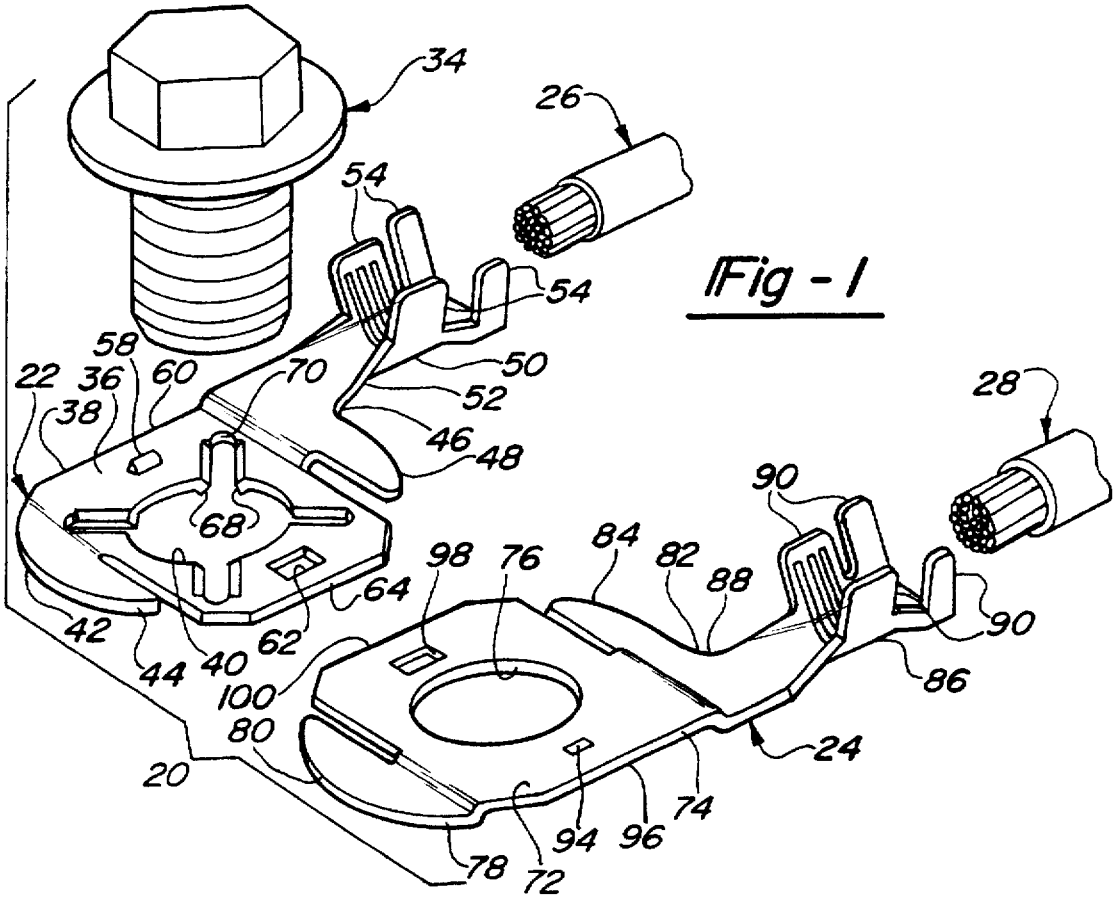
FIG. 1 is an exploded perspective view of the interlocking terminal connection of the present invention.

The present invention provides an interlocking terminal connection 20 generally comprising a first terminal plate 22 and a second terminal plate 24 for connecting a pair of wires 26, 28 to an electrically grounded location such as a metal frame or panel utilizing a fastener, such as a threaded fastener or screw 34.

The first terminal plate 22 includes an upper surface 36 and an opposite lower surface (not shown). The first terminal plate 22 includes a generally planar base portion 38 having a hole 40 for receiving the screw 34. The first terminal plate 22 further includes an outer wing portion 42 which is displaced upwardly, preferably by an amount at least equal to the thickness of the base portion 38. The outer wing portion 42 includes a forwardly extending interlocking finger 44. The first terminal plate includes an inner wing portion 46 opposite the outer wing portion 42. The inner wing portion 46 is also upwardly displaced from the base portion 38 and includes a forwardly extending interlocking finger 48.

The first terminal plate 22 includes a terminal crimp 50 at an inner end 52 of the first terminal plate 22. The terminal crimp 50 generally comprises a plurality of fingers 54 for crimping around the wire 26. Alternatively, the wire can be soldered, glued, secured by a threaded fastener, or otherwise secured in a conductive manner to the first terminal plate 22. It should be recognized that more than one wire may be secured to a single terminal plate 22, such as by crimping the fingers 54 of the terminal crimp 50 about a plurality of wires.

The first terminal plate 22 includes an upwardly lanced latch 58 at a rearward end 60 of the base portion 38 and a latch window 62 at a forward end 64 of the base portion 38.

A plurality of downwardly deformed lanced retaining members 68 are radially spaced about the circumference of the hole 40 in the base portion 38 of the first terminal plate 22. The retaining members 68 of the base portion 38 of the first terminal plate 22 are preferably formed by extending four channels 70 from the hole 40 in the base portion 38. Two portions of material adjacent each channel 70 are then downwardly deformed to form the retaining members 68. Preferably, the base portion 38 adjacent each retaining member 68 is partially lanced.

The second terminal plate 24 includes an upper surface 72 and an opposite lower surface (not shown). The second terminal plate 24 includes a generally planar base portion 74 having a hole 76 to receive the screw 34. The second terminal plate 24 includes an outer wing portion 78 which is downwardly displaced from the base portion 74 and which includes a forwardly extending interlocking finger 80. The second terminal plate 24 further includes an inner wing portion 82 which is also downwardly displaced from the base portion 74. The inner wing portion 82 also includes a forwardly extending interlocking finger 84. A terminal crimp 86 for connecting the second terminal plate 24 to a wire 28 is disposed at the inner end 88 of the second terminal plate 24. The terminal crimp 86 includes a plurality of deformable fingers 90 for crimping around at least one wire 28 to connect to the second terminal plate 24.

The second terminal plate 24 also includes a downwardly deformed lanced latch 94 at a rearward end 96 of the base portion 74. The second terminal plate 24 further includes a latch window 98 at the forward end 100 of the base portion 74. The latch window 98 is complementary to the latch 58 on the base portion 38 of the first terminal plate 22. It should be apparent that positions of the latches 58, 94 and latch windows 62, 98 could be switched or could be located at other locations on the first terminal plate 22 and second terminal plate 24. It is preferred that the latch on one terminal plate is located at a complementary location to a latch window on the other terminal plate.

Figure 2:
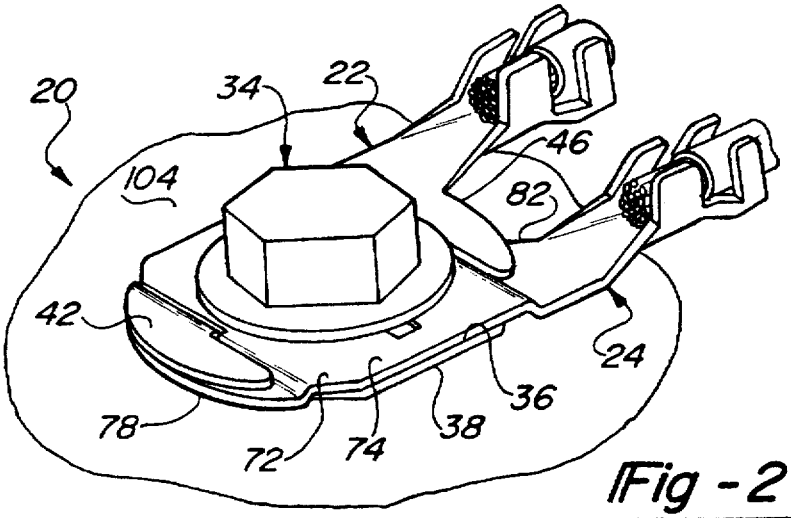
FIG. 2 is a perspective view of the terminal connection of FIG. 1 secured to a panel in an interlocked, latched position.

As can be seen in FIG. 2, the first terminal plate 22 and the second terminal plate 24 are slidably inserted and interlocked with the base portion 74 of the second terminal plate 24 on the upper surface 36 of the base portion 38 of the first terminal plate 22 and the wing portions 42, 46 of the first terminal plate 22 on the upper surfaces 72 of the wing portions 78, 82 of the second terminal plate 24, respectively. The first terminal plate 22 and the second terminal plate 24 are then slidably connected until reaching a latched position as shown in FIG. 2. The screw 34 is then inserted through the first terminal plate 22 and the second terminal plate 24 and threaded into the panel 104.

Figure 3:
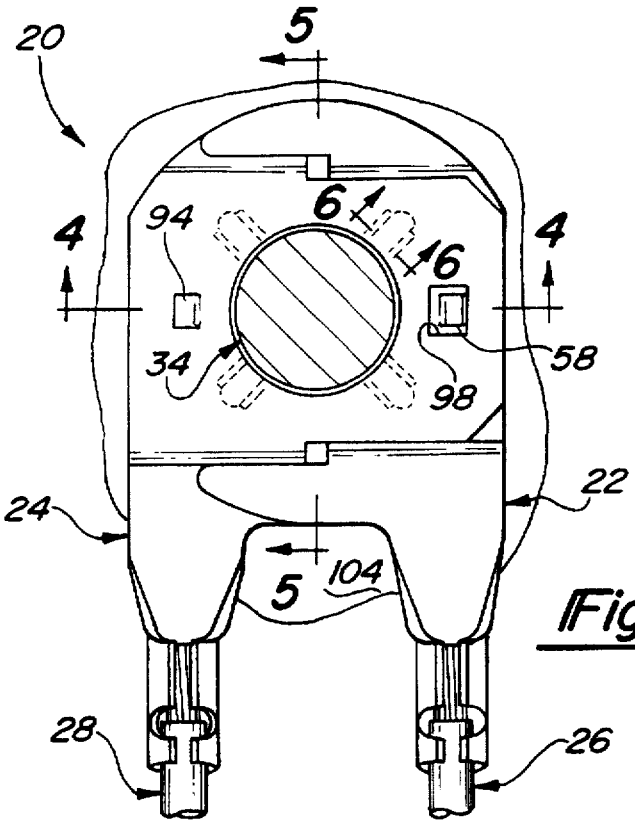
FIG. 3 is a plan view of the terminal connection shown in FIG. 2.
Figure 4:
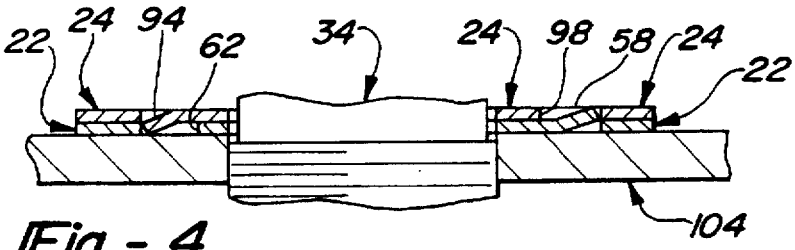
FIG. 4 is a cross-section taken along lines 4—4 of FIG. 3.

As can be seen in FIGS. 3 and 4, in the latched position, the latch 58 on the first terminal plate 22 is received in the latch window 98 of the second terminal plate 24 and the latch 94 of the second terminal plate 24 is received in the latch window 62 of the first terminal plate 22.

Figure 5:
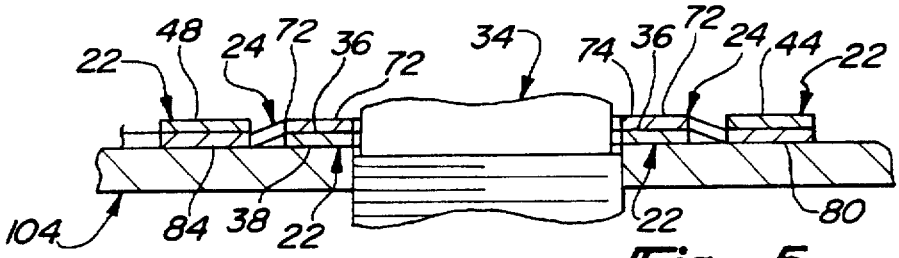
FIG. 5 is a cross-section through line 5—5 of FIG. 3.

Referring to FIG. 5, in the interlocked latched position, the interlocking fingers 44, 48 of the first terminal plate 22 abut the upper surface 72 adjacent the interlocking fingers 80, 84 of the second terminal plate 24. The base portion 74 of the second terminal plate 24 abuts the upper surface 36 adjacent the base portion 38 of the first terminal plate 22. In this preferred form, the interlocking terminal connection 20 is approximately only the thickness of the two terminal plates 22, 24. It should be recognized that, for example, if the wing portions 78, 82 of the second terminal plate 24 were not displaced from the base portion 74, the wing portions 42, 46 on the first terminal plate 22 would have to be displaced by an amount at least two times the thickness of the terminal plates 22, 24, resulting in a total thickness of three times the thickness of the terminal plates 22, 24.

Figure 6:
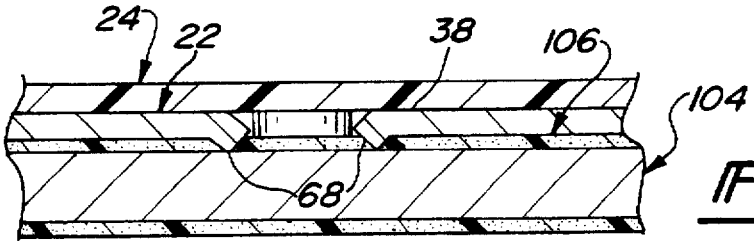
FIG. 6 is a cross-section taken along line 6—6 of FIG. 3.

As can be seen in FIG. 6, during the tightening of the screw 34, the retaining members 68 extending downwardly from the base portion 38 of the first terminal plate 22 grab the panel 104 to prevent the unwanted rotation of the first terminal plate 22 and the second terminal 24. The retaining members 68 also cut through paint 106 or dirt to achieve good electrical contact with the panel 104.

Figure 7:
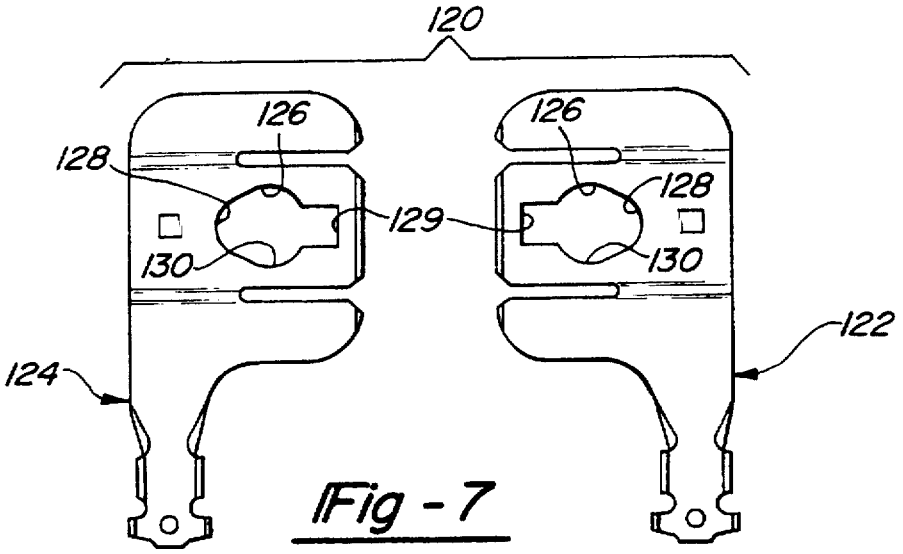
FIG. 7 is an exploded plan view of an optional embodiment of the terminal connection of FIG. 1.

An optional interlocking terminal connection 120 is shown in FIG. 7. A first plate 122 and preferably a second plate 124 each include a hole 126 having a rearward portion 128 of reduced diameter and a forward portion 130 of increased diameter. The holes 126 can include the latch window portions 129.

Figure 8:
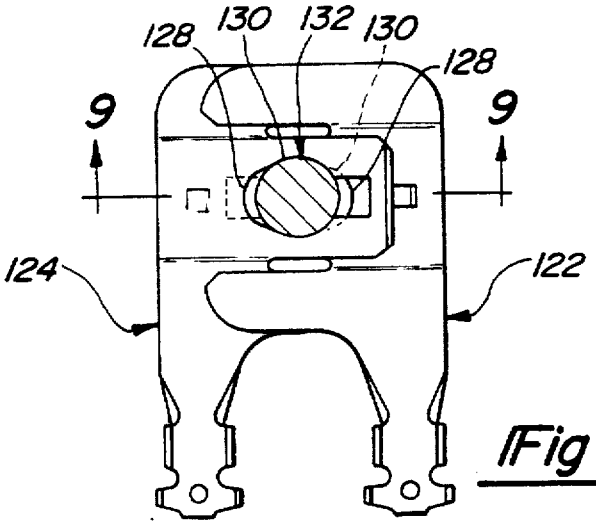
FIG. 8 is a plan view of the terminal connection of FIG. 7 in an interlocked, unlatched position.

As shown in FIG. 8, when the first plate 122 is partially inserted into the second plate 124, such that the first plate 122 and second plate 124 are interlocked but not latched, the forward portions 130 of increased diameter will be sufficiently aligned to permit insertion of the fastener 132. The fastener 132 is inserted through the first plate 122 and second plate 124.

Figure 9:
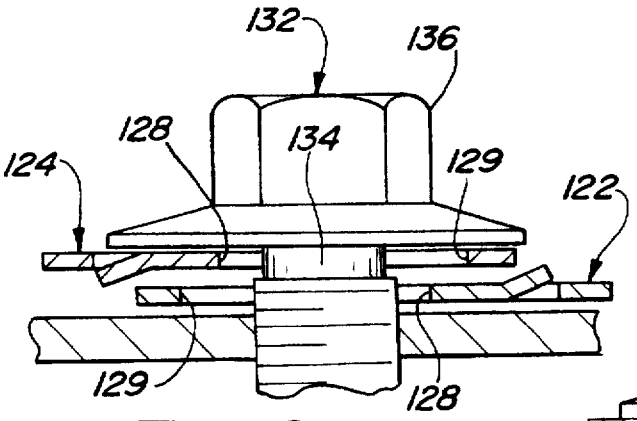
FIG. 9 is a cross-section taken along line 9—9 of FIG. 8.

As can be seen in FIG. 9, the fastener 132 includes a portion of reduced diameter, or undercut 134, preferably adjacent the head 136. The fastener 132 is inserted through the first plate 122 and second plate 124 until the undercut 134 is aligned with the first and second plates 122, 124.

Figure 10:
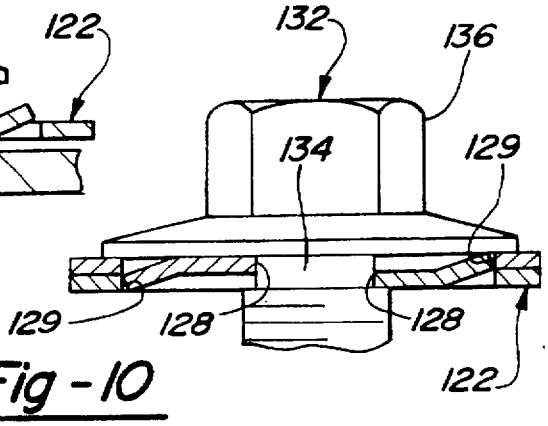
FIG. 10 is the terminal connection of FIG. 9 in an interlocked, latched position.

The first plate 122 and second plate 124 are then fully inserted and latched as shown in FIG. 10. The rearward portions 128 of the holes 126 in the first and second plates 122, 124 are then substantially aligned, such that the first plate 122 and second plate 124 are partially disposed in the undercut 134. The terminal connection 120 thus retains the fastener 132 while permitting rotation of the fastener 132 relative to the first plate 122 and second plate 124. The terminal connection 120 with the retained fastener 132 is then easily assembled by threading the fastener 132 into a panel or frame.

As can be seen from the drawings, the base portions of the first and second plates are generally parallel and circumscribe the holes in the base portions which receive the fastener. The wing portions of the first and second plate extend laterally and forwardly from rearward ends of the base portions. The plates include a slit between the base portion and the wing portion opening at a forward edge extending rearwardly generally to a point beyond the forward edge of the hole. As can be appreciated from the drawings and the abovedescription, forward edges of the plate may be initially aligned and subsequently slid over the hole of the other of the plates until the wing portions of the second plate abuts one of the upper surface and the lower surface of the first plate with the base portion of the second plate abutting the other of the upper surface and the lower surface of the first plate.

It should be apparent that the terms "upwardly" and "downwardly" in this description are with reference to the drawings only, and that the interlocking terminal connection of the present invention would be operable in any orientation. Further, although described with respect to the example of providing an electrical ground to a panel or frame, the terminal connection of the present invention could be used to connect two or more wires to any conductive or non-conductive object. It should also be recognized that although a threaded fastener is commonly used for grounding terminal connections, other methods or devices for fastening known to those in the relevant art could also be used to connect the terminal connection to any object, depending upon the particular application.

Further, if necessary in a particular application, more than one pair of the terminal plates 22, 24 can be stacked, preferably rotatably offsetting adjacent pairs by 90 degrees. The retaining members 68 on each first terminal plate 22 prevents rotation between the pair of terminal plates 22, 24. It is also possible to mate a pair of first terminal plates 22 (or a pair of second terminal plates 24), by inverting one first terminal plate 22 (or one second terminal plate 24), in which case one terminal crimp would extend upwardly, and the other terminal crimp would extend downwardly.

In accordance with the provisions of the patent statutes, the prevent invention has been described in what is considered to represent its preferred embodiment. However, it should be noted that the invention can be practiced otherwise than as specifically illustrated and described without departing from its spirit or scope.

What is claimed is:

1. An electrical connection comprising:

a first plate having a hole for receiving a fastener in a base portion, said first plate including an upper surface and an opposite lower surface, said first plate including a wing portion extending from said base portion, said wing portion displaced from said base portion, said first plate secured to a wire;

a second plate having a hole for receiving a fastener in a base portion, said second plate including an upper surface and an opposite lower surface, said second plate including at least one wing portion extending from said base portion, said second plate connected to a wire;

said base portions of said first and second plates each including a forward edge forward of said hole, said base portions of said first and second plates each being generally planar and each circumscribing said holes for receiving a fastener, said wing portions of said first and second plates extending laterally and forwardly from rearward ends of said base portions, said plates each including a slit between said base portion and said wing portion opening at said forward edge and extending rearwardly generally to a point beyond a forward edge of said hole such that said forward edges of said plates may be initially aligned and subsequently slid over the hole of the other of said plates until said wing portion of said second plate abuts one of said upper surface and said lower surface of said first plate, said base portion of said second plate abutting the other of said upper surface and said lower surface of said first plate; and a fastener insertable through said holes in said first plate and said second plate.

2. The electrical connection of claim 1, wherein said wing portion of said second plate abuts said lower surface of said first plate, said base portion of said second plate abutting said upper surface of said first plate, said first plate further including at least one downwardly deformed member extending from said lower surface of said base portion of said first plate, said downwardly deformed member preventing rotation of said first plate.

3. The electrical connection of claim 1 wherein said base portions of said first and second plates are generally planar and each circumscribe said holes for receiving a fastener, said wing portions of said first and second plates extending laterally and forwardly from rearward ends of said base portions.

4. The electrical connection of claim 1, wherein said first plate includes a pair of wing portions extending from opposite sides of said base portion, said wing portions displaced from said base portion, said second plate including a pair of wing portions extending from opposite side of said base portion.

5. The electrical connection of claim 4, wherein said wing portions on said second plate are displaced from said base portion on said second plate.

6. The electrical connection of claim 5, wherein said wing portions on said first plate are displaced in a first direction and said wing portions on said second plate are displaced in a second direction opposited said first direction, said wing portions on said first plate abutting said upper surface of said second plate, said base portion of said first plate abutting said lower surface of said second plate.

7. The electrical connection of claim 1, wherein at least one of said first plate and said second plate includes a latch, the other of said first plate and said second plate including a complementary latch window, said latch received in said latch window to prevent separation of said first plate and said second plate.

8. The electrical connection of claim 7, wherein said latch is disposed on said base portion of said first plate, said latch window being disposed on said base portion of said second plate.

9. The electrical connection of claim 1, wherein at least one of said hole in said first plate and said hole in said second plate has a rearward portion of reduced diameter and a forward portion of increased diameter, said fastener being insertable through said forward portion when said first plate and said second plate are partially slid together, said fastener being retained by said rearward portion when said first plate and said second plate are fully slid together.

10. The electrical connection of claim 9, wherein at least one of said first plate and said second plate includes a latch, the other of said first plate and said second plate including a complementary latch window, said latch receivable in said latch window to prevent separation of said first plate and said second plate, said first and second plates having an unlatched position wherein said base portion of said second plate abuts said upper surface of said first plate and said latch is not received in said latch window, said first and second plates having a latched position wherein said latch is received in said latch window, said fastener having a diameter such that it is insertable through said holes in said first and second plates when said first and second plates are in said unlatched position, said fastener being retained by said rearward portion of reduced diameter when said first and second plates are in said latched position.

11. The electrical connection of claim 10, wherein said fastener includes a shaft having a portion of reduced diameter defining an undercut, said fastener retained by said first and second plate disposed in said undercut when said first plate and said second plate are in said latched position.

12. An electrical connection comprising:

a first plate secured to a first wire, said first plate including an upper surface and an opposed lower surface, said first plate including a plurality of downwardly deformed retaining members extending from said lower surface, said first plate having a first hole for inserting a fastener;

a second plate secured to a second wire, said second plate slidably interlocked with said first plate, said second plate including a second hole for inserting a fastener, said base portions of said first and second plates each including a forward edge forward of said hole, said second plate having a generally planar base portion circumscribing said second hole for receiving a fastener, said second plate including an upper surface and an opposite lower surface, said second plate including at least one wing portion extending laterally and forwardly form a rearward end of said base portion;

said first plate comprising a generally planar base portion circumscribing said first hole, said first plate including an upper surface and an opposite lower surface, said first plate including a wing portion extending laterally and forwardly from a rearward end of said base portion, said wing portion displaced from said base portion, said plates each including a slit between said base portion and said wing portion opening at said forward edge and extending rearwardly generally to a point beyond a forward edge of said hole such that said forward edges of said plates may be initially aligned and subsequently slid over the hole of the other of said plates until said wing portion of said second plate abuts one of said upper surface and said lower surface of said first plate, said base portion of said second plate abutting the other of said upper surface and said lower surface of said first plate; and a threaded fastener disposed in said hole in said first and second plates, said fastener threadably securing said plates to an object, said object adjacent said lower surface of said first plate and abutting said retaining members on said first plate.

13. The electrical connection of claim 12, wherein said first plate includes a plurality of channels extending radially from said hole, a pair of said retaining members formed by downwardly deforming opposing, generally parallel portions on either side of each said channel of said first plate.

14. The electrical connection of claim 12, further comprising:

said second plate having a generally planar base portion circumscribing said second hole for receiving a fastener, said second plate including an upper surface and an opposite lower surface, said second plate including at least one wing portion extending laterally and forwardly from a rearward end of said base portion, said second plate connected to a wire;

wherein said first plate comprises a generally planar base portion circumscribing said first hole, said first plate including an upper surface and an opposite lower surface, said first plate including a wing portion extending laterally and forwardly from a rearward end of said base portion, said wing portion displaced from said base portion;

said base portions of said first and second plates each including a forward edge forward of said hole, said forward edges of said plates initially aligned and subsequently slid over the hole of the other of said plates until said wing portion of said second plate abuts one of said upper surface and said lower surface of said first plate, said base portion of said second plate abutting the other of said upper surface and said lower surface of said first plate.

* * * * *